US007921526B2

(12) United States Patent
Wangbunyen

(10) Patent No.: US 7,921,526 B2
(45) Date of Patent: Apr. 12, 2011

(54) ZIP FASTENER

(75) Inventor: Tanakorn Wangbunyen, Bangkok (TH)

(73) Assignee: Tanakorn Wangbunyen, Bangkok (TH)

( * ) Notice: Subject to any disclaimer, the term of this patent is extended or adjusted under 35 U.S.C. 154(b) by 182 days.

(21) Appl. No.: 11/312,206

(22) Filed: Dec. 20, 2005

(65) Prior Publication Data

US 2007/0137005 A1 Jun. 21, 2007

(51) Int. Cl.
*A44B 19/36* (2006.01)

(52) U.S. Cl. ..... 24/381; 24/387

(58) Field of Classification Search ..... 24/381, 24/386

See application file for complete search history.

(56) References Cited

U.S. PATENT DOCUMENTS

| | | | | |
|---|---|---|---|---|
| 1,986,785 | A * | 1/1935 | Argy | 24/435 |
| 2,438,780 | A * | 3/1948 | Hochner | 190/119 |
| 3,561,073 | A * | 2/1971 | Rosser | 24/432 |
| 3,648,293 | A | 3/1972 | Del Vecchio | |
| 4,510,655 | A * | 4/1985 | Asahi | 24/382 |
| 5,111,919 | A * | 5/1992 | Hamatani et al. | 190/109 |
| 6,532,633 | B2 * | 3/2003 | Chu | 24/429 |
| 6,877,192 | B2 * | 4/2005 | Tominaga et al. | 24/381 |
| 2002/0015537 | A1 | 2/2002 | Strand et al. | |
| 2003/0103690 | A1 | 6/2003 | Schneider et al. | |

FOREIGN PATENT DOCUMENTS

| | | | |
|---|---|---|---|
| EP | 179368 | A2 * | 4/1986 |
| JP | 2001335070 | | 12/2001 |

* cited by examiner

*Primary Examiner* — Jack W. Lavinder

(74) *Attorney, Agent, or Firm* — Steven L. Nichols; Van Cott, Bagley, Cornwall & McCarthy P.C.

(57) ABSTRACT

A zip fastener (30) comprised of a long strip of two thermoplastic support tapes (35); two rows of coupling elements (40), each row being attached to its own support tape (35); and a slider body (45) comprising a puller (50) attached to the slider body (45). Portions of the two support tapes (35) are shaped to cause the two rows of coupling elements (40) to rest higher or lower than the shaped portions of the support tapes (35). At least one end portion of the zip fastener (30) is curved downward and in a closed position the curved portion (75) accommodates at least one slider body (45).

8 Claims, 10 Drawing Sheets

ZIP FASTENER

BACKGROUND

Zippers and other zip fasteners are commonly used for joining together edges of two pieces of material. They may be used to provide a closeable slit in a unit or may be used to join two separate pieces of material. They are widely used in the clothing industry as well as other industries, with almost any type of material.

A conventional zipper or zip fastener is comprised of two support tapes; two rows of coupling elements, each row being attached to its own support tape; and a slider element comprised of a puller attachment used to open or close the zip fastener.

Typically, when a conventional zip fastener is closed, there are slits between each coupling element. In addition, there is always a small opening at the distal end of the zip fastener where the width of the slider prevents the coupling elements at the distal end from locking together. When a conventional zip fastener is exposed to water, the water tends to collect around the zip fastener permitting water to seep through the coupling elements or the opening at the distal end of the zip fastener.

In addition, in a conventional zip fastener, when the slider unites the coupling elements, the puller and top part of the slider body are clearly visible. Unless the zip fastener is designed as a decoration for an article, the zip fastener tends to disrupt the smoothness of the article's surface making it unpleasing to the eye.

A tunnel, sometimes referred to as a garage, is created in an attempt to cover the opening at the distal end of the zip fastener as well as to hide the puller and the slider body. However, creating a tunnel or a garage is time consuming and/or undesirable in some cases and does not effectively reduce the problem of water seeping through the coupling elements. Therefore, there is a need for an improved zip fastener that further reduces the aforementioned problems and disadvantages of the conventional zip fastener.

SUMMARY

The present specification describes a zip fastener with improved characteristics capable of reducing the problem of water seeping through the coupling elements as well as through the opening located at the distal end of the zip fastener. The zip fastener described herein, once attached to the article, is less likely to disrupt the smoothness of the article and hides from view the unsightly puller and slider body without using a tunnel or garage.

The present specification also describes, among other things a thermoforming method of using heat and pressure to transform a thermoplastic substrate into a zip fastener.

BRIEF DESCRIPTION OF THE DRAWINGS

The accompanying drawings illustrate various embodiments of the present invention and are a part of the specification. The illustrated embodiments are merely examples of the present invention and do not limit the scope of the claims.

Throughout the drawings, identical reference numbers designate similar, but not necessarily identical, elements.

DETAILED DESCRIPTION

Figure 2:
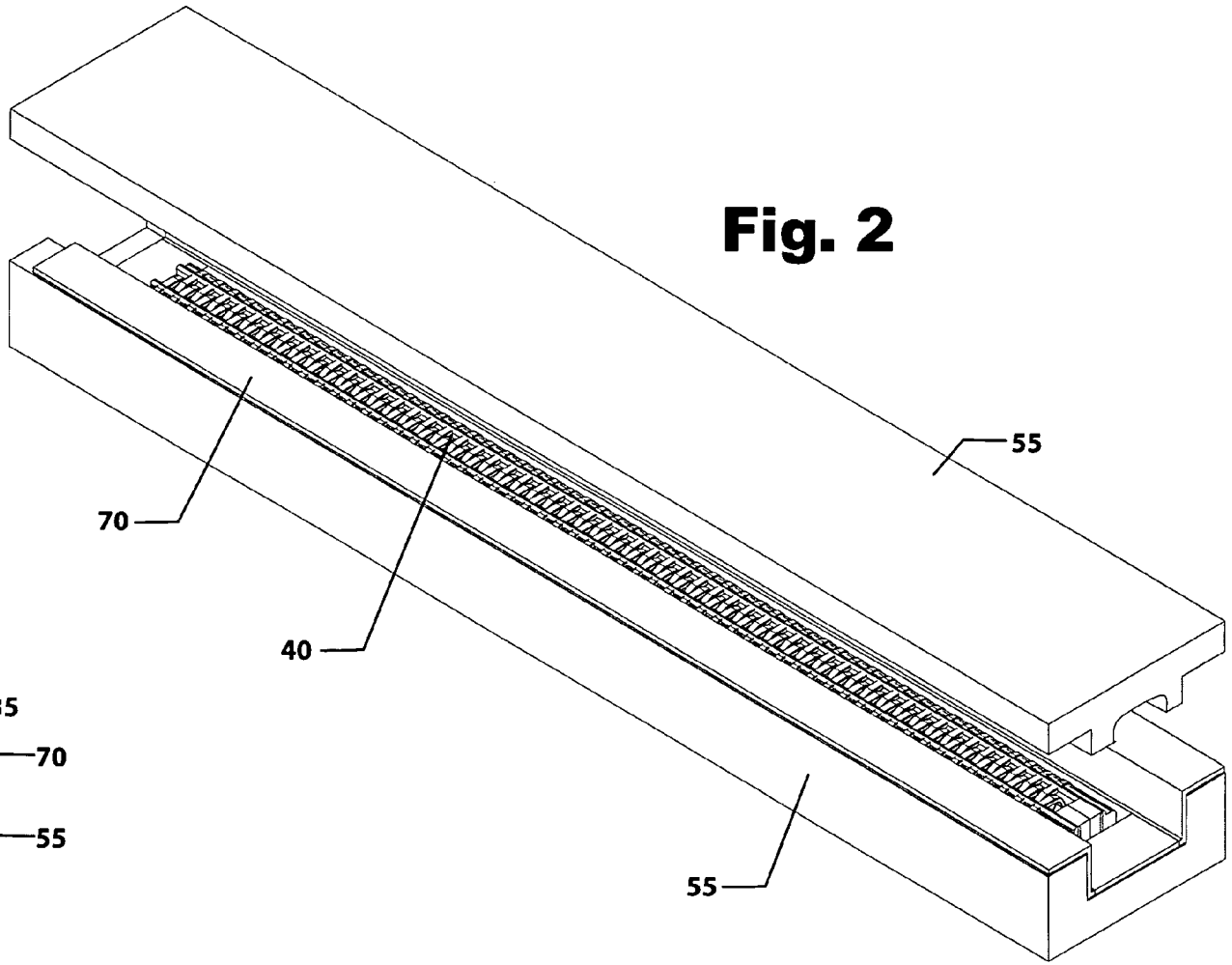
FIG. 2 shows a perspective view of the zip fastener of FIG. 1 inside the mould.
Figure 1:
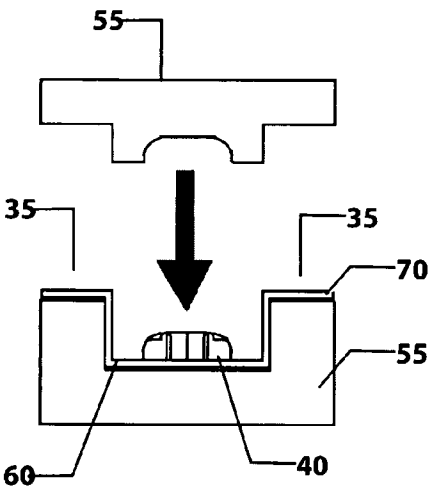
FIG. 1 shows a cross sectional view of one embodiment of the zip fastener inside a mould according to principles described herein.
Figure 3:
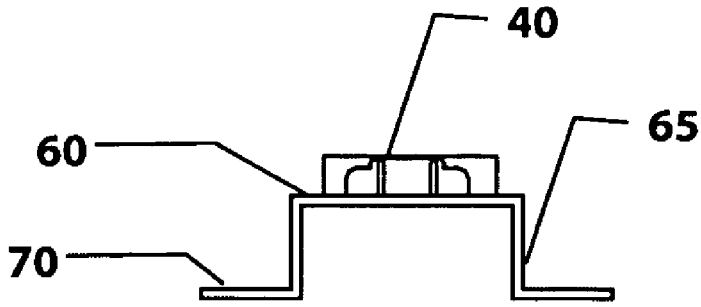
FIG. 3 shows a cross sectional view of one embodiment of the zip fastener shaped into an inverted U-shape.
Figure 5:
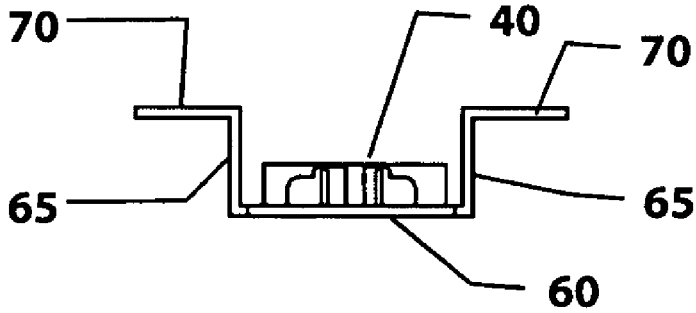
FIG. 5 shows a cross sectional view of one embodiment of the zip fastener shaped into a U-shape.

To illustrate the principles disclosed in this specification, various examples or embodiments of zip fasteners herein will now be described. However, the principles described herein are not limited to or by these examples.

A zipper or zip fastener (30) according to principles described herein includes first and second support tapes (35), each of which has one row of coupling elements (40) each row being attached to each support tape (35), and a slider body (45) including a puller (50). The support tapes (35), coupling elements (40), slider body (45) and puller (50) may be of any standard shape and structure. However, modifications are made in the zip fastener (30) to the shapes and structures of the two support tapes (35).

The support tapes (35) are thermo-plasticized and portions of the first and second support tapes (35) are shaped into a U-shape, V-shape, inverted U-shape, expanded V-shape, or curve-shape by using a mold (55) and thermoforming. Shaping of the support tapes (35) through molding causes the coupling element (40) to situate either between or above the shaped support tapes (35).

Accordingly, the thermo plasticized first and second support tapes (35) having the coupling elements (40) engaged with the opposed row, to which the slider (45) and the puller (50) have not yet been attached are placed between two halves of the mold (55) having the desired configuration. In the example of FIG. 2, the mould has a U-shape. The strip of thermoplastic support tapes (35) having the coupling element (40) attached inside the mold (55) is then heated to a temperature between 80-180° C. to shape or transform the support tapes (35) into the configuration corresponding to the mold. While still inside the mold (55), the strips of support tapes (35) are left to cool while still under pressure so that the desired configuration is maintained. Once cooled, the shaped support tapes (35) are removed from the mold (55)

Figure 4:
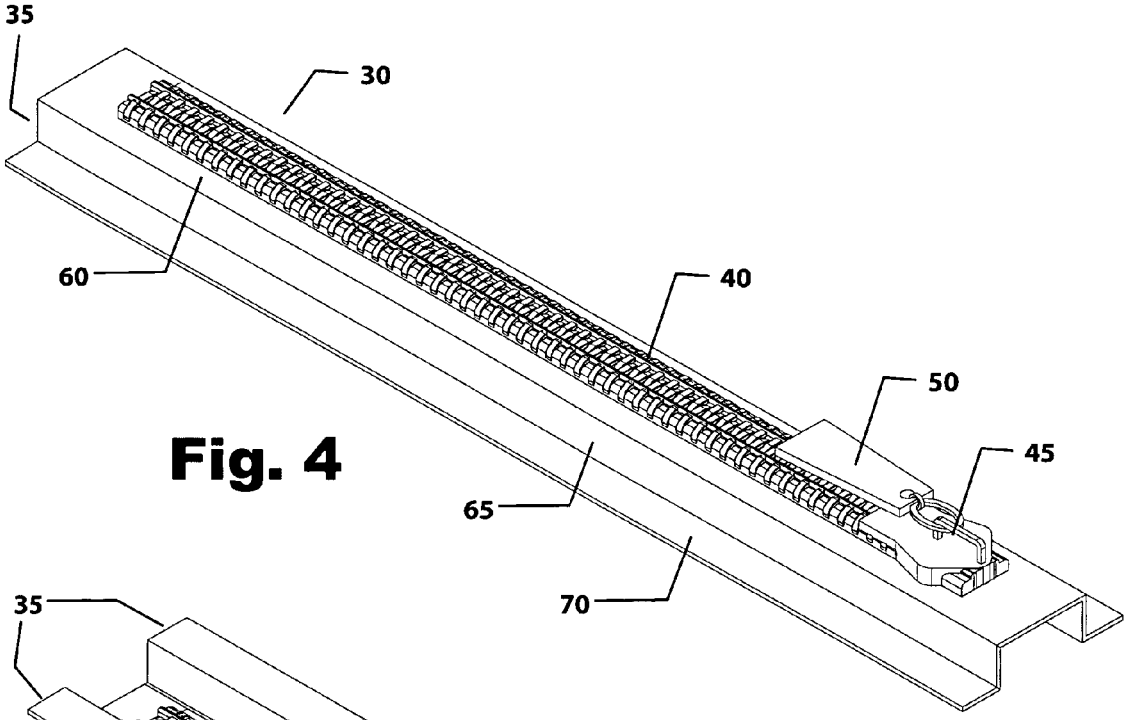
FIG. 4 shows a perspective view of the zip fastener of FIG. 3.

FIG. 4 shows the second embodiment of the zip fastener (30) according to this specification wherein the first and second support tapes (35) are shaped to form an inverted U-shape. As shown, one end portion (60) of the first and second support tapes (35) of which the coupling element (40) sits on the top of the inverted U-shape, the middle portion (65) of the support tapes (35) is bent downward and the free end portion (70) of the support tapes (35) is bent outward to be on the same plane with the end portion (60) with the attached coupling element (40). As a result, the middle portion (65) and the free end portions (70) of the support tapes (35) in turn act as a support for the coupling elements (40) sitting on the top of the inverted U-shape creating a zip fastener (30) with a coupling element (40) on the support tapes (35) higher than the normally flat zip fastener.

Figure 6:
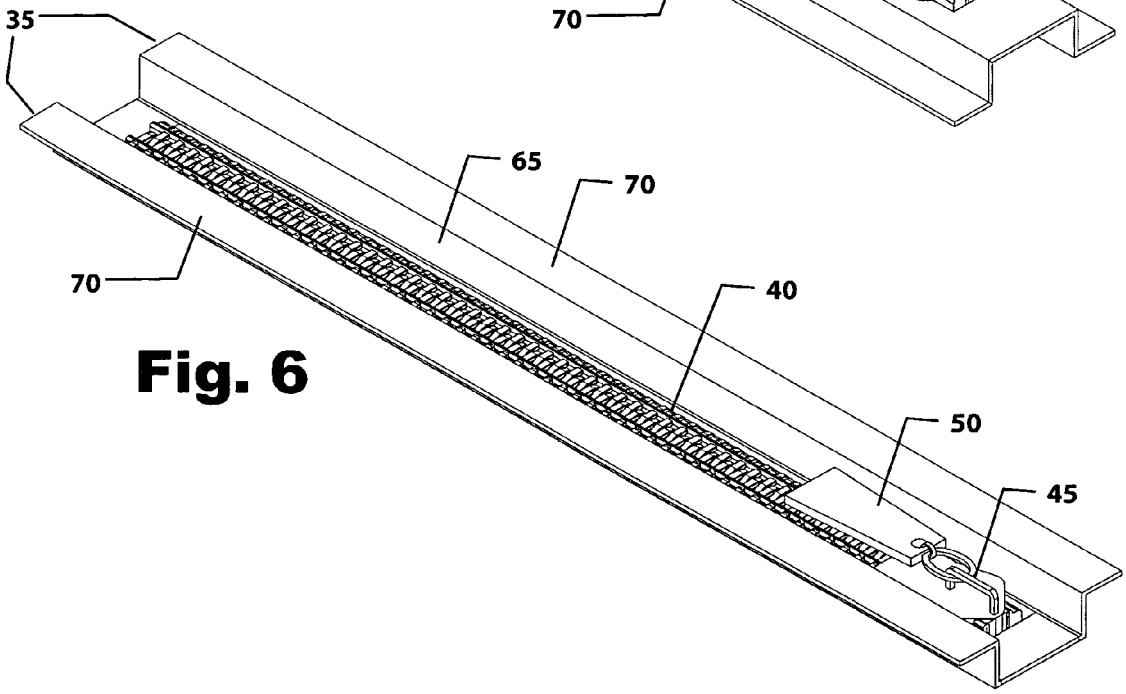
FIG. 6 shows a perspective view of the zip fastener of FIG. 5.
Figure 7:
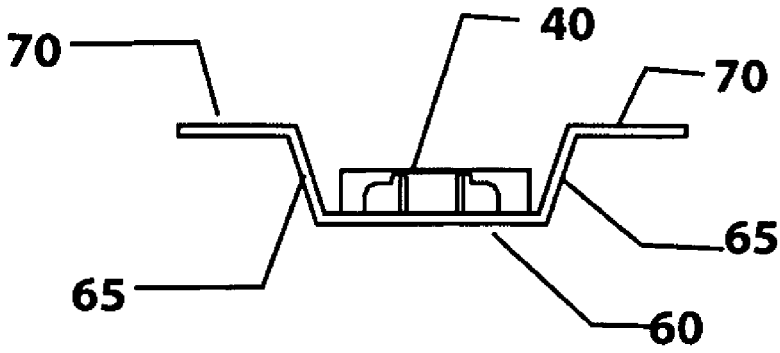
FIG. 7 a shows cross sectional view of one embodiment of the zip fastener shaped into an expanded V-shape.
Figure 9:
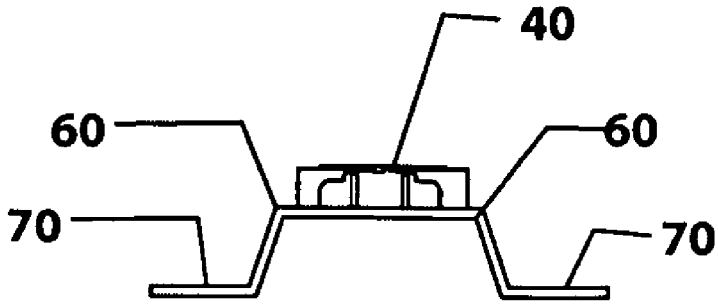
FIG. 9 shows a cross sectional view of one embodiment of the zip fastener shaped into an inverted and expanded V-shape.

FIG. 6 shows another embodiment of the zip fastener (30) according to this invention wherein the first and second support tapes (35) are shaped to form a U-shape. In this embodiment, using the coupling element (40) as a reference point, the end portion (60) of the first and second support tapes (35) with the attached coupling element (40) act as a base. The middle portion (65) of support tapes (35) is vertically lifted up and the free end portion (70) of the first and second support tapes (35) is horizontally bent to the same plane with the end portion (60) of which the coupling element attached. Thereby, the U-shaped zip fastener (30) with the coupling element (40) inside the U-shape is obtained.

Figure 8:
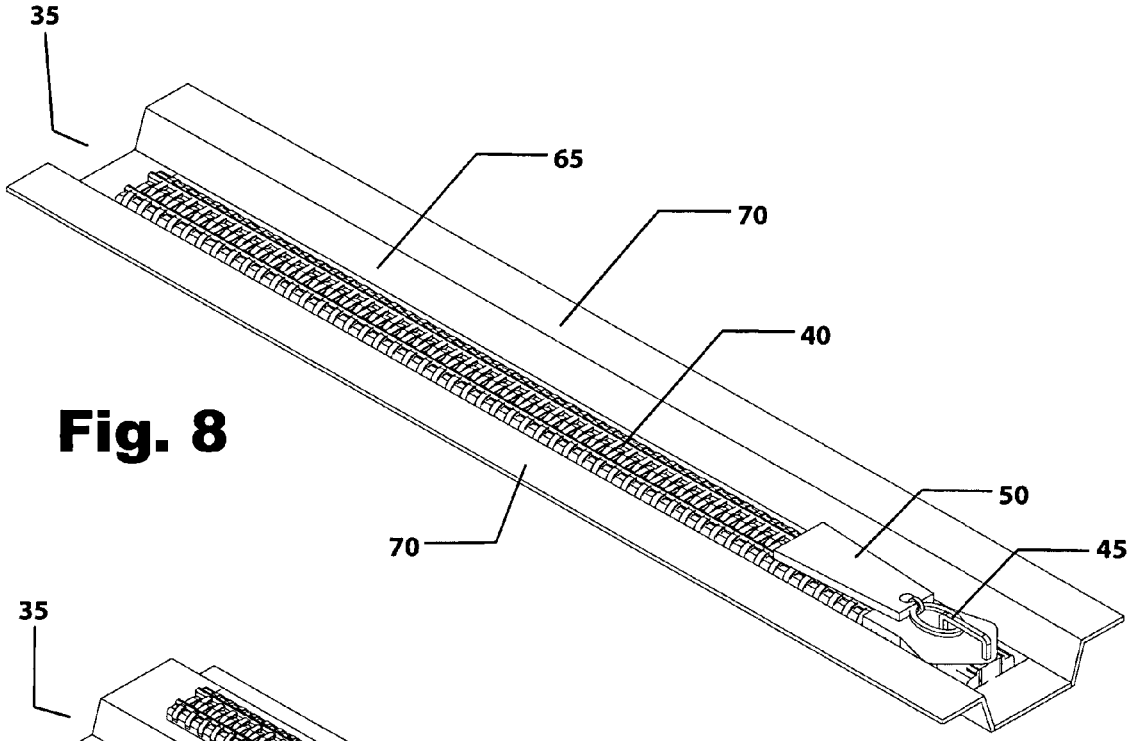
FIG. 8 shows a perspective view of the zip fastener of FIG. 7.
Figure 10:
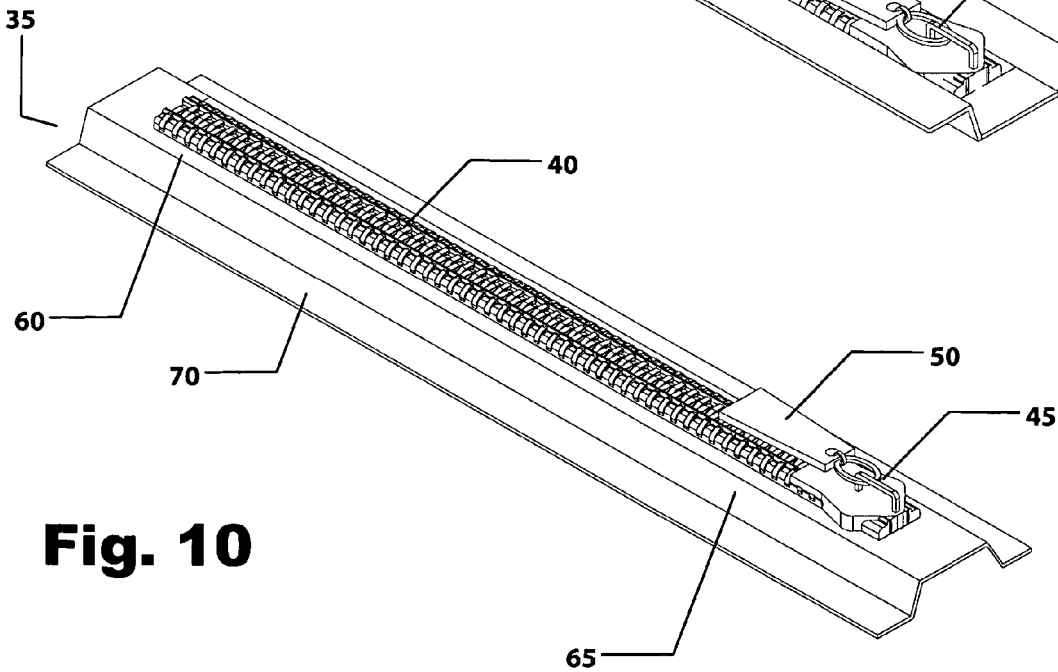
FIG. 10 shows a perspective view of the zip fastener of FIG. 9.
Figure 11:
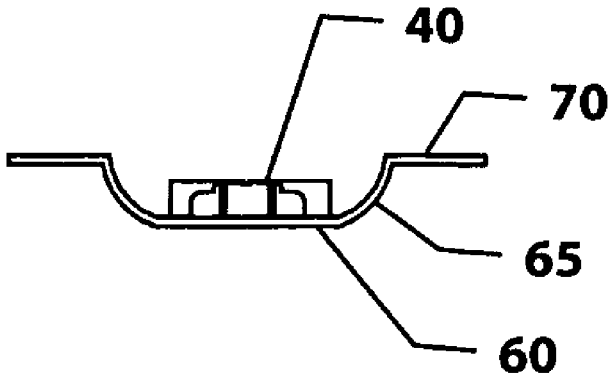
FIG. 11 shows a cross sectional view of one embodiment of the zip fastener shaped into a curve shape.
Figure 13:
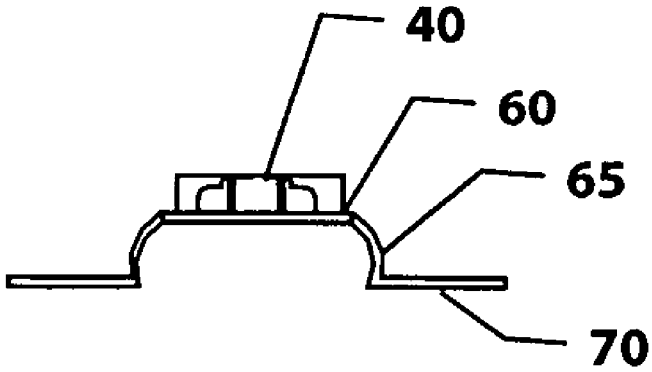
FIG. 13 shows a cross sectional view of one embodiment of the zip fastener shaped into an inverted curve shape.
Figure 12:
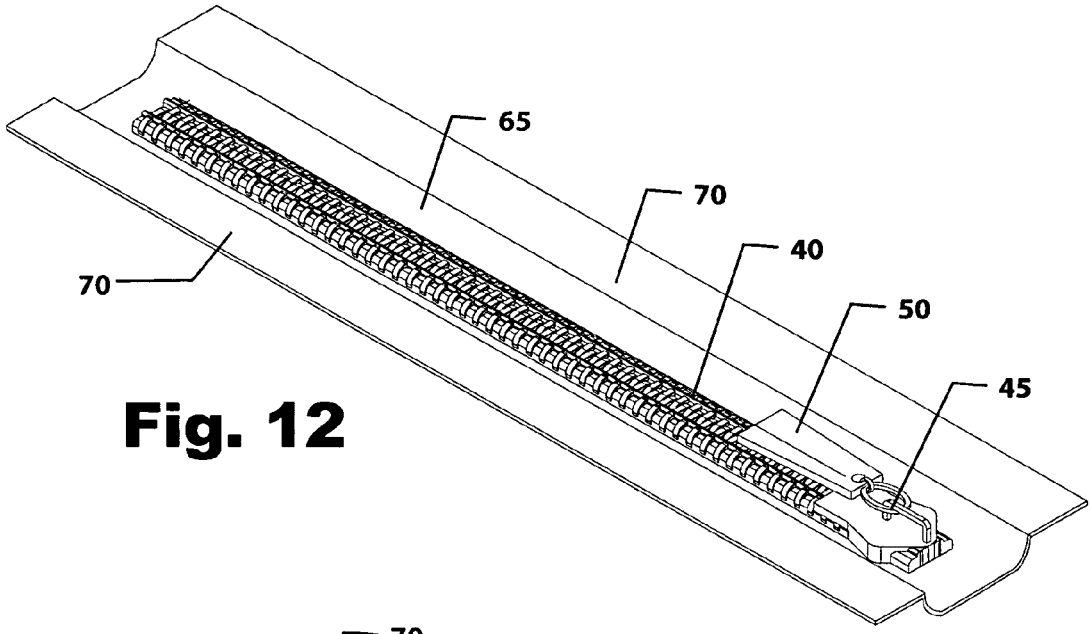
FIG. 12 shows a perspective view of the zip fastener of FIG. 11.
Figure 14:
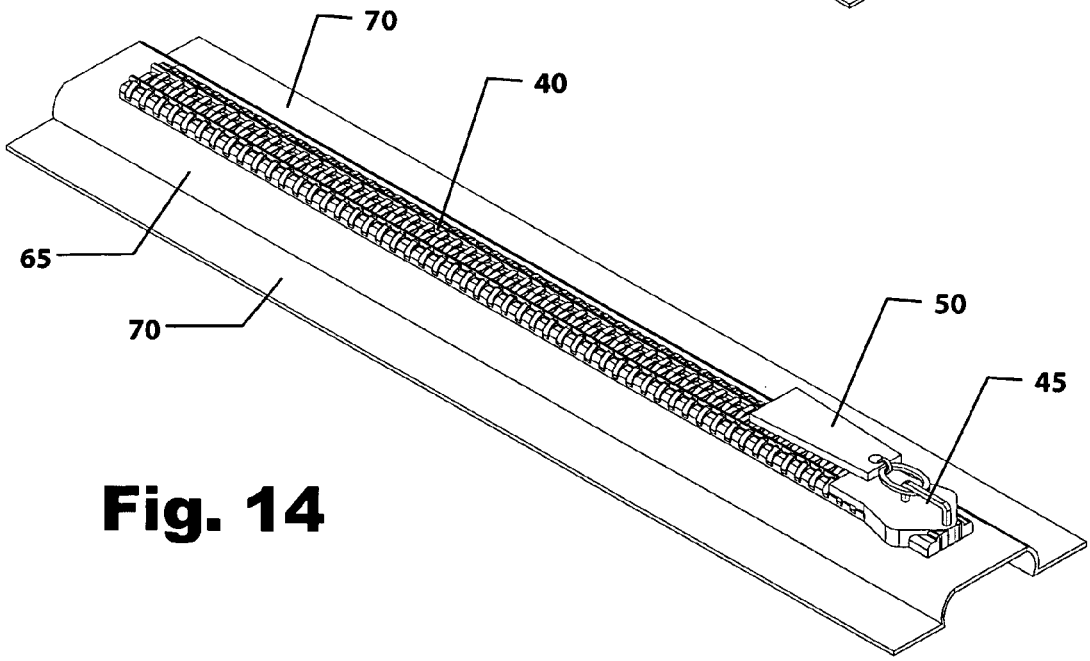
FIG. 14 shows a perspective view of the zip fastener of FIG. 13.

Further examples and additional embodiments of the zip fastener according to these principles are as shown in FIG. 8 and FIG. 10 in which the zip fastener (30) is shaped into an expanded V-shape and inverted V-shape, respectively. FIG. 12 and FIG. 14 show further embodiments of the zip fastener (30) according to the present disclosure. In these embodiments, portions of the first and second support tapes (35), including the end portion (60) of which the coupling element (40) is attached and the middle portion (65), are merged and are shaped into a curve. The coupling element (40) may be on the top of the curve or inside the curve similar to the U-shape.

Figure 15:
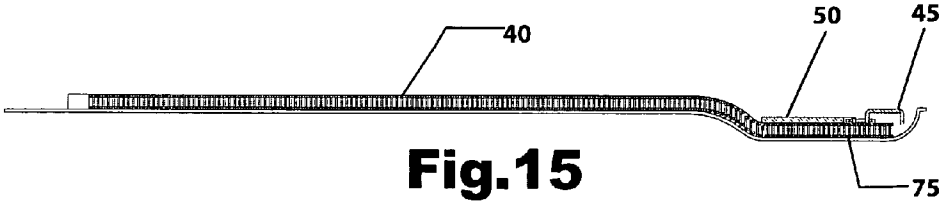
FIG. 15 shows a side view of one embodiment of the zip fastener with one end curved downward and the curve accommodating one slider body.
Figure 16:
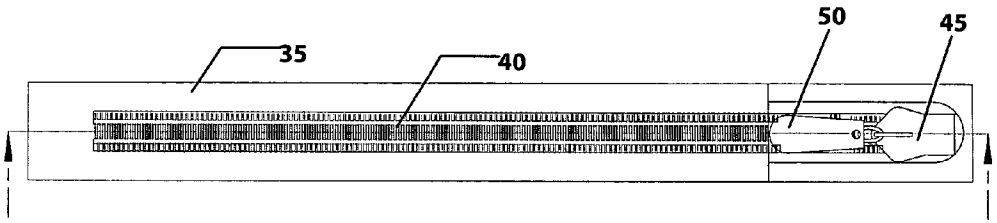
FIG. 16 shows a top view of the zip fastener of FIG. 15.
Figure 17:
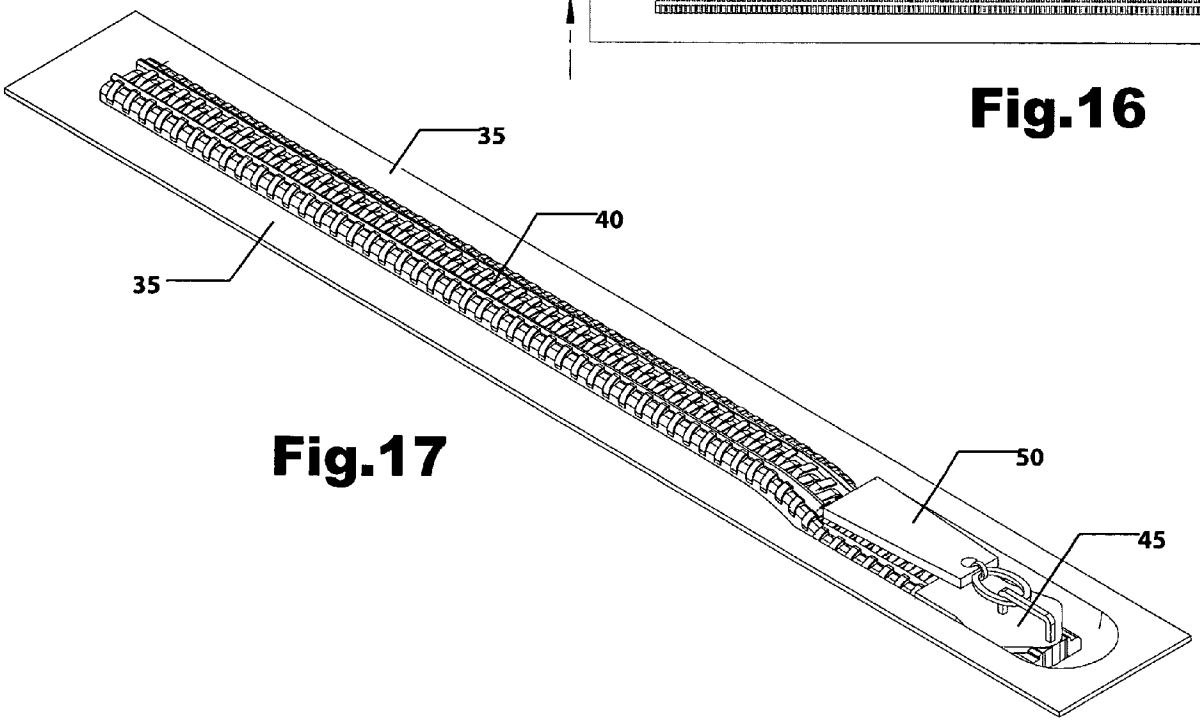
FIG. 17 shows a perspective view of the zip fastener of FIG. 15.
Figure 18:
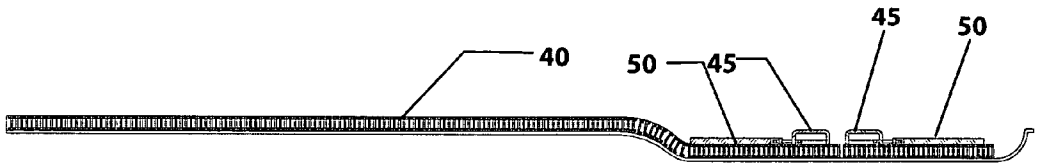
FIG. 18 shows a side view of one embodiment of the zip fastener with one end curved downward and the curve accommodating two slider bodies.
Figure 19:
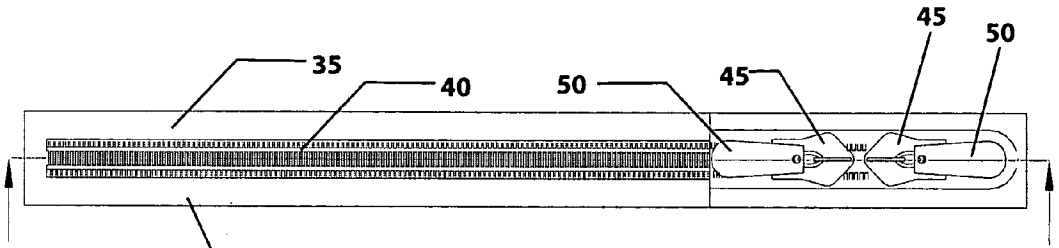
FIG. 19 shows a top view of the zip fastener of FIG. 18.
Figure 20:
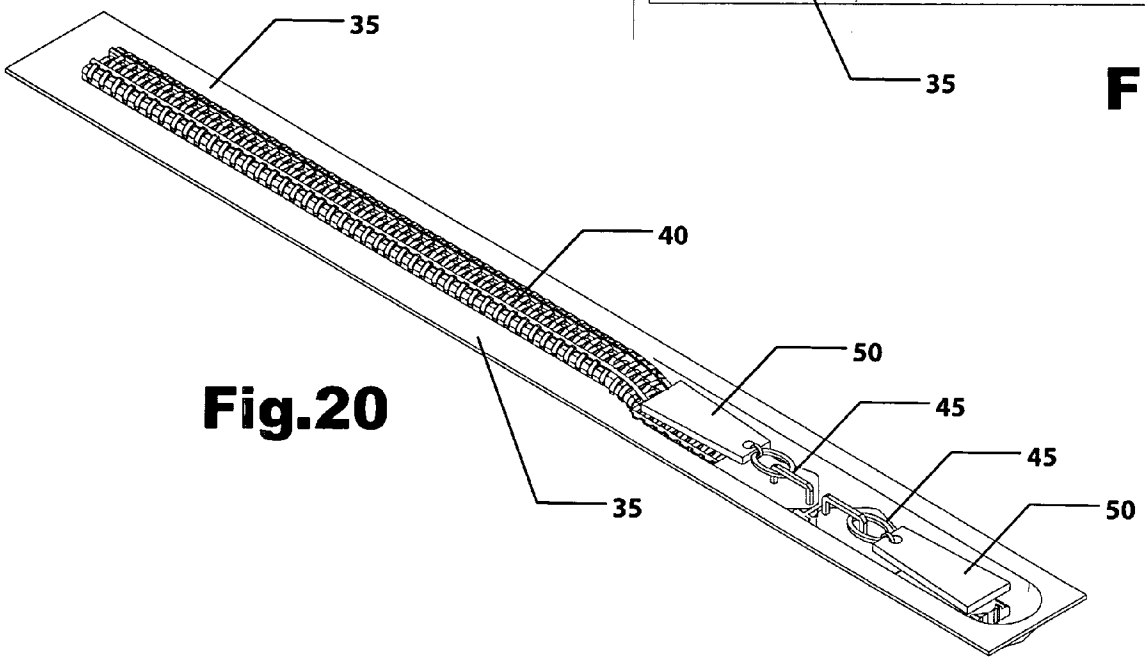
FIG. 20 shows a perspective view of the zip fastener of FIG. 18.
Figure 21:
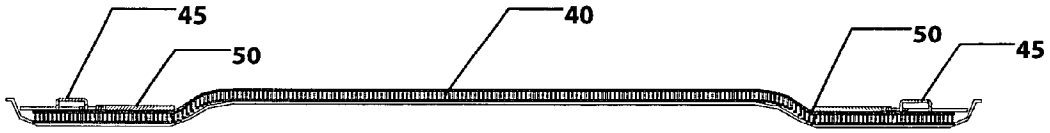
FIG. 21 shows a side view of one embodiment of the zip fastener with both ends curved downward and each curve accommodating one slider body.
Figure 22:
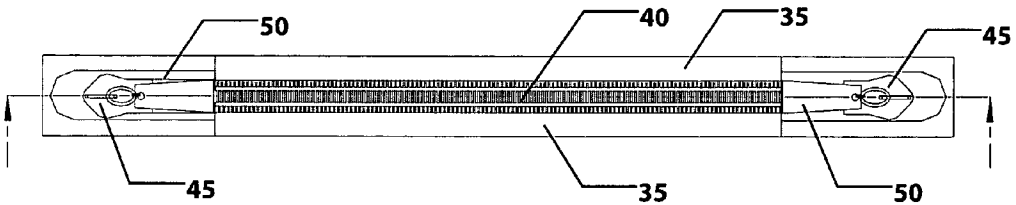
FIG. 22 shows a top view of the zip fastener of FIG. 21.
Figure 23:
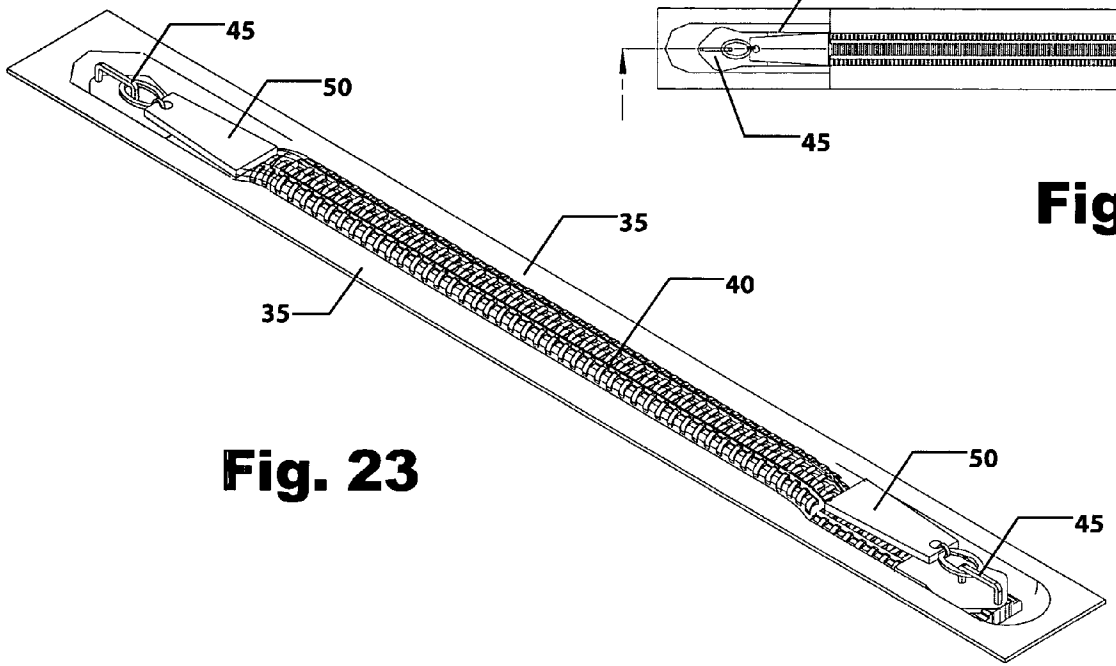
FIG. 23 shows a perspective view of the zip fastener of FIG. 21.

In yet another embodiment of the zip fastener (30) according to the principles of the present specification, as shown in FIG. 15 and FIG. 18, the support tapes (35) are flat and one end or both ends of the support tapes (35) are curved downward forming a recess in the support tapes. This is also obtained by thermoforming using the mold (55) under controlled temperature and pressure. When the slider (45) and the puller (50) are assembled to the strip of the support tapes (35) with the coupling element (40) attached, the curved portion (75) of the support tapes (35) will be where the slider body (45) rests in the closed position of the zip fastener (30). The curved portion (75) of the zip fastener (30) accommodates at least one slider body (45) as shown in FIG. 17. After being attached to the article, the curved portion (75) lies beneath the surface of the article. As a result, the slider body (45) as well as the puller (50) is hidden from view creating a smoother look on the surface of the article. As the slider body (45) is hidden under the surface of the article, the opening, caused when the width of the slider body obstructs the coupling elements at the distal end from engaging with each other will also be protected by the article's surface. This eliminates the need for the tunnel or garage while effectively reducing the chance of water passing through the opening.

Once the zip fastener (30) described herein, particularly, the embodiment where the coupling element (40) sits high on the first and second support tapes (35) such as the inverted U-shape, inverted expanded V-shape, is assembled to the article and is subsequently exposed to water, the water is less likely to seep through the coupling element (40). This is because the water tends to flow away from the coupling element (40) area onto the surface adjacent to the zip fastener (30) rather than pooling as in the conventional zip fastener. This is particularly suitable for use with watertight/waterproofed articles. For the embodiment of which portions of the first and second support tapes (35) were lifted up, such as in the U-shape, expanded V-shape, and curve shape the coupling element (40) rests between the lifted portions of the first and second support tapes (35). Once the slider body (45) is assembled to form a zip fastener (30), the slider body (45) is housed within the lifted up portions of the first and second support tapes (35), creating a smoother look on the article's surface as the slider body (45) and the puller (50) are hidden from view, or if so desired, the entire zip fastener (30) can be hidden resulting in an even smoother look on the article's surface.

As illustrated in the various embodiments, the zip fastener (30) according to the principles described herein may be shaped into any desired configuration for various purposes and can be used with various types of material including clothing articles, canvas, etc.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A zip fastener comprising:

two support tapes, each support tape comprising a zip coupling portion, a middle portion, and a free end portion;

two rows of coupling elements, in which each row of coupling elements are attached to said zip coupling portion of a respective support tape; and a number of slider bodies;

in which, for each support tape, a surface of the zip coupling portion and a surface of the free end portion are substantially parallel to each other and the middle portion is shaped such that the zip coupling portion and the free end portion are held apart from each other, and the two rows of coupling elements are above the middle portion and the free end portion of the support tapes, in which the support tapes comprise at least one curved portion along the length of the support tapes, the curved portion defining a recess, the recess comprising a number of the coupling elements, and in which the recess accommodates at least one slider body.

2. The zip fastener of claim 1, wherein the two support tapes are shaped to have any of a U-shape, inverted U-shape, curve shape, inverted curve shape, expanded V-shape, and inverted expanded V-shape.

3. The zip fastener of claim 1, wherein the recess accommodates two slider bodies.

4. The zip fastener of claim 1, wherein at least one end of the zip fastener comprises said curved portion.

5. The zip fastener of claim 1, in which the two support tapes comprise a thermoplastic material.

6. The zip fastener of claim 1, wherein each support tape is shaped with portions being at a right angle.

7. The zip fastener of claim 1, in which the recess of the support tapes lies beneath the surface of an article to which the zip fastener is attached.

8. A zip fastener comprising:

two support tapes;

two rows of coupling elements, each row attached to a zip coupling portion of a respective support tape; and in which the two support tapes are flat except at least at one end of the zip fastener where the zip coupling portion is indented such that, when the fastener is in a closed position, the indent accommodates at least one slider body.

* * * * *